United States Patent [19]

Challener

[11] 4,146,477

[45] Mar. 27, 1979

[54] MATERIAL RECOVERY APPARATUS

[75] Inventor: Ronald T. Challener, Bournemouth, England

[73] Assignee: Oil Mop (U.K.) Limited, Christchurch, England

[21] Appl. No.: 805,477

[22] Filed: Jun. 10, 1977

[30] Foreign Application Priority Data

Jun. 17, 1976 [GB] United Kingdom ..... 25181/76

[51] Int. Cl.[2] ..... E02B 15/04

[52] U.S. Cl. ..... 210/143; 210/242 AS; 210/DIG. 26

[58] Field of Search ..... 210/30 A, 242 AS, 242 S, 210/DIG. 25, DIG. 26, 143

[56] References Cited

U.S. PATENT DOCUMENTS

| | | | |
|---|---|---|---|
| 3,612,280 | 10/1971 | Fitzgerald et al. | 210/242 S |
| 3,640,394 | 2/1972 | Brill et al. | 210/DIG. 26 |
| 3,668,118 | 6/1972 | Rhodes | 210/30 A |
| 3,695,451 | 10/1972 | Schmidt, Jr. et al. | 210/DIG. 25 |
| 3,700,593 | 10/1972 | Bezemer et al. | 210/DIG. 26 |
| 3,701,258 | 10/1972 | Rhodes | 210/DIG. 26 |
| 3,744,638 | 7/1973 | Rhodes | 210/242 AS |
| 3,836,004 | 9/1974 | Favret | 210/DIG. 25 |
| 3,990,975 | 11/1976 | McLellan | 210/242 AS |
| 4,052,313 | 10/1977 | Rolls | 210/DIG. 26 |

*Primary Examiner*—Robert H. Spitzer
*Attorney, Agent, or Firm*—Kenyon & Kenyon, Reilly, Carr & Chapin

[57] ABSTRACT

The present disclosure is directed to material recovery apparatus comprising a rope of an adsorbent material arranged for floating on the surface of a liquid contaminated by a contaminating material preferentially adsorbed by the rope, the rope being in the form of a continuous loop extending between a desorption station through which the rope is advanced to remove adsorbed material and a floating rope guide structure at which the rope is guided around guide means. The rope guide structure is so constructed as automatically under the pull of the rope during relative movement between the desorption station and the liquid to bring the rope into a disposition in which a part at least of the length thereof has a component of motion over the surface of the liquid and relative thereto which is transverse to the longitudinal direction of the said part. The rope guide structure furthermore includes steering means responsive to deviations in the tension of the rope from a predetermined tension so to steer the rope guide structure as to maintain or tend to maintain the tension of the rope at said predetermined tension.

16 Claims, 4 Drawing Figures

MATERIAL RECOVERY APPARATUS

Figure 1:
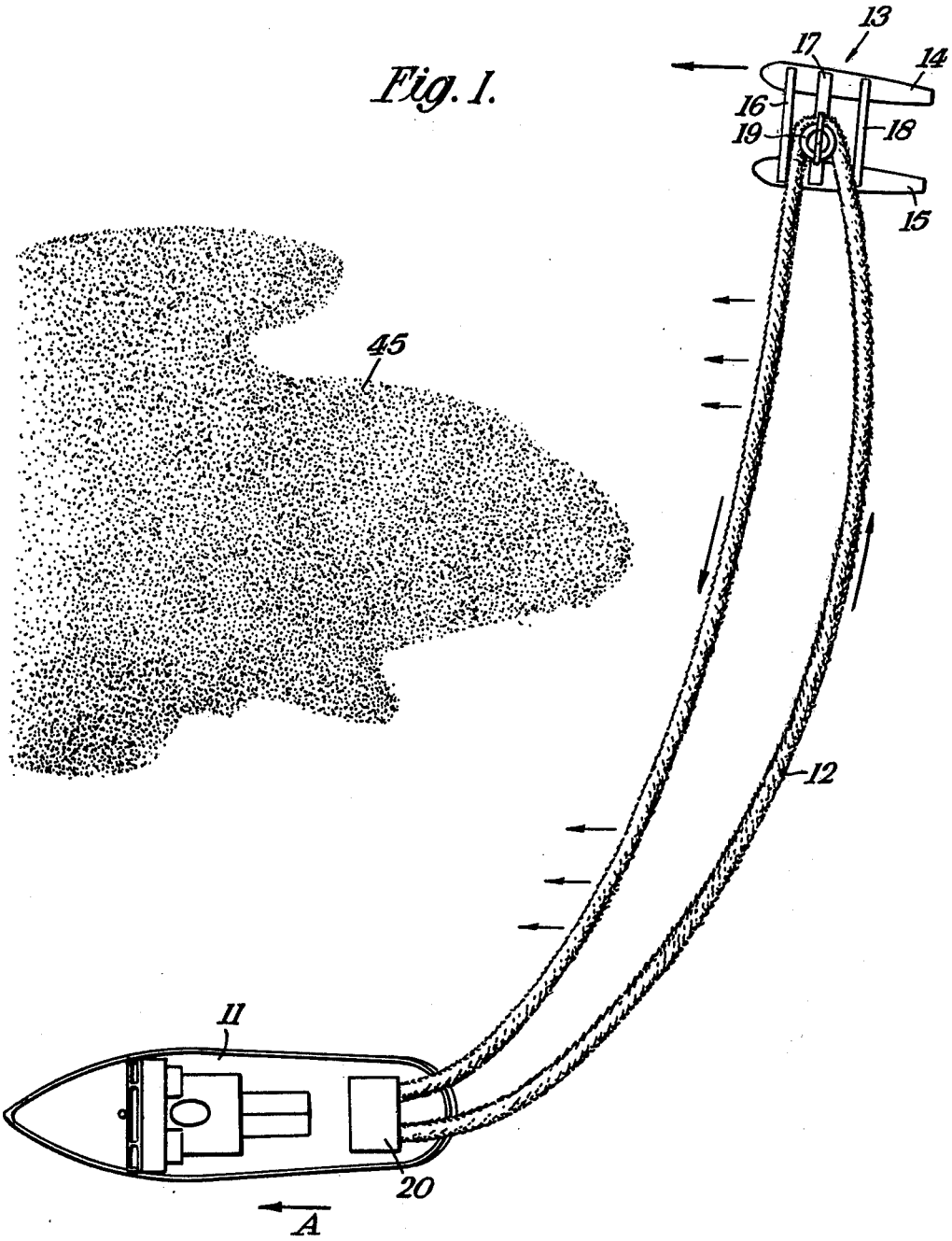

The present invention relates to material recovery apparatus and is particularly although not exclusively concerned with a recovery apparatus for the removal of oil from the surface of water in large harbours and under open sea conditions.

In an oil recovery apparatus hitherto proposed, use has been made of a buoyant rope which has the property of preferentially adsorbing oil in relation to water and which is formed as a continuous loop which floats on the water between a desorption station where it is advanced through an oil desorption means and a rope-guide station remote from the desorption station where the run of the loop is guided round a guide pulley floating on the water. The rope is continuously advanced in its run over the water, around the pulley and through the desorption unit, the oil being removed from the incoming run of the rope to produce a continuously cleaned return run for a further advance over the oil contaminated water.

The oil desorption station may simply comprise a pair of squeeze rollers through the nip of which the rope is caused to pass, the rollers serving to wring out oil in the oil-laden run advanced to it whilst providing the drive for the advancement of the rope. For heavy duty operation additional squeeze rollers may be provided or the oil-laden rope may be caused to make more than one pass through the single pair of squeeze rollers.

The desorption station in one hitherto proposed apparatus takes the form of a barge moving slowly through the oil-contaminated water, while the rope-guide station comprises a small manned boat which is advanced slowly through the water, drawing with it a floating pulley around which the rope is guided, the dispositions of the desorption station and rope-guide station being so arranged as to bring the rope loop into or hold it in a position in which it is most effective for picking up and containing the oil floating on the water.

While the use of a small manned boat as the rope-guide station gives good flexibility to the recovery apparatus, additional personnel are required to man the boat, leading to prohibitive operating costs.

According to the present invention, there is provided material recovery apparatus comprising a rope of an adsorbent material arranged for floating on the surface of a liquid contaminated by a contaminating material preferentially adsorbed by the rope, the rope being in the form of a continuous loop extending between a desorption station through which the rope is advanced to remove adsorbed material and a floating rope guide structure at which the rope is guided around guide means, said rope guide structure being so constructed as automatically under the pull of the rope during relative movement between the desorption station and the liquid to bring the rope into a disposition in which a part at least of the length thereof has a component of motion over the surface of the liquid and relative thereto which is transverse to the longitudinal direction of the said part and said rope guide structure including steering means responsive to deviations in the tension of the rope from a predetermined tension so to steer the rope guide structure as to maintain or tend to maintain the tension of the rope at said predetermined tension.

Figure 2:
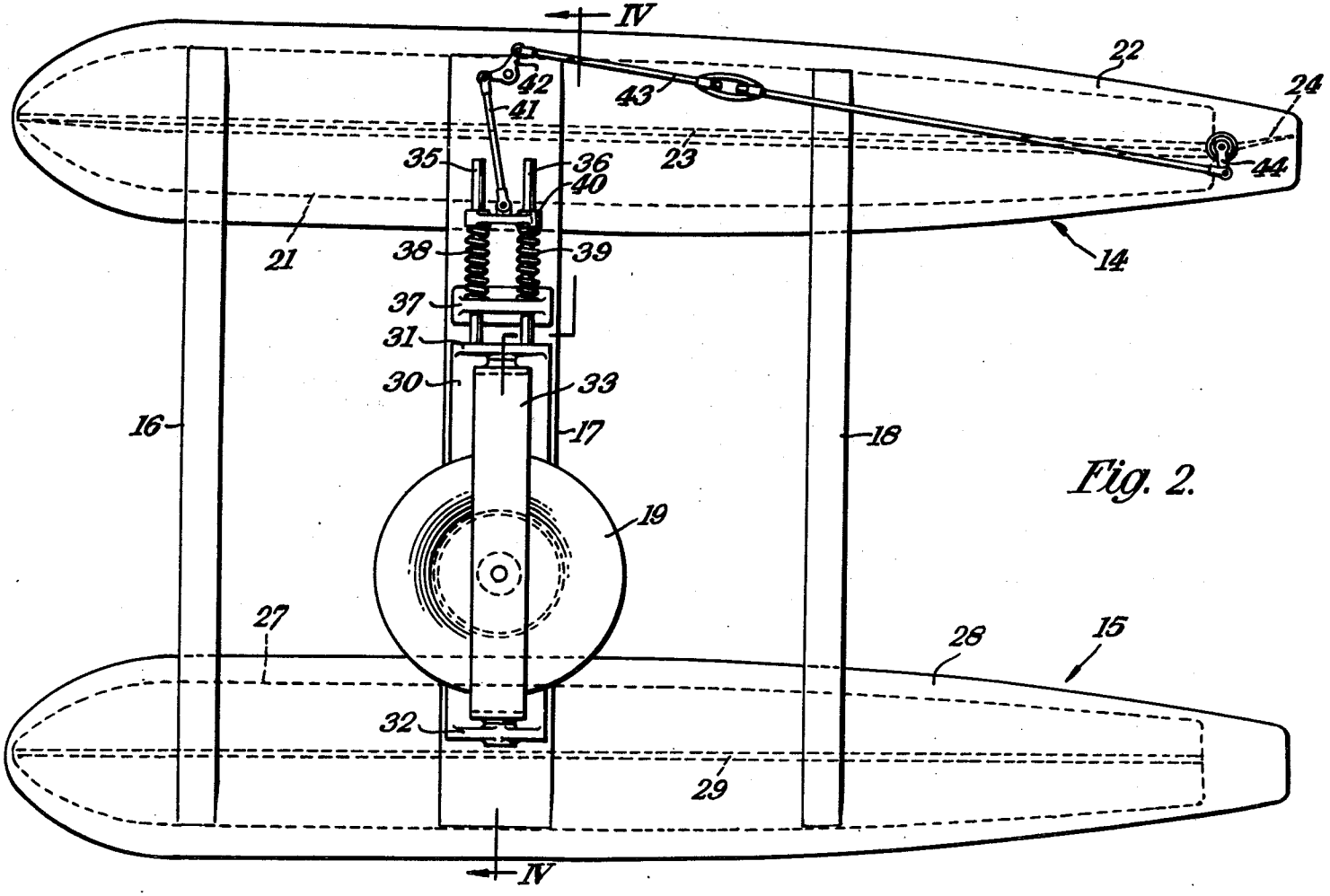
Figure 3:
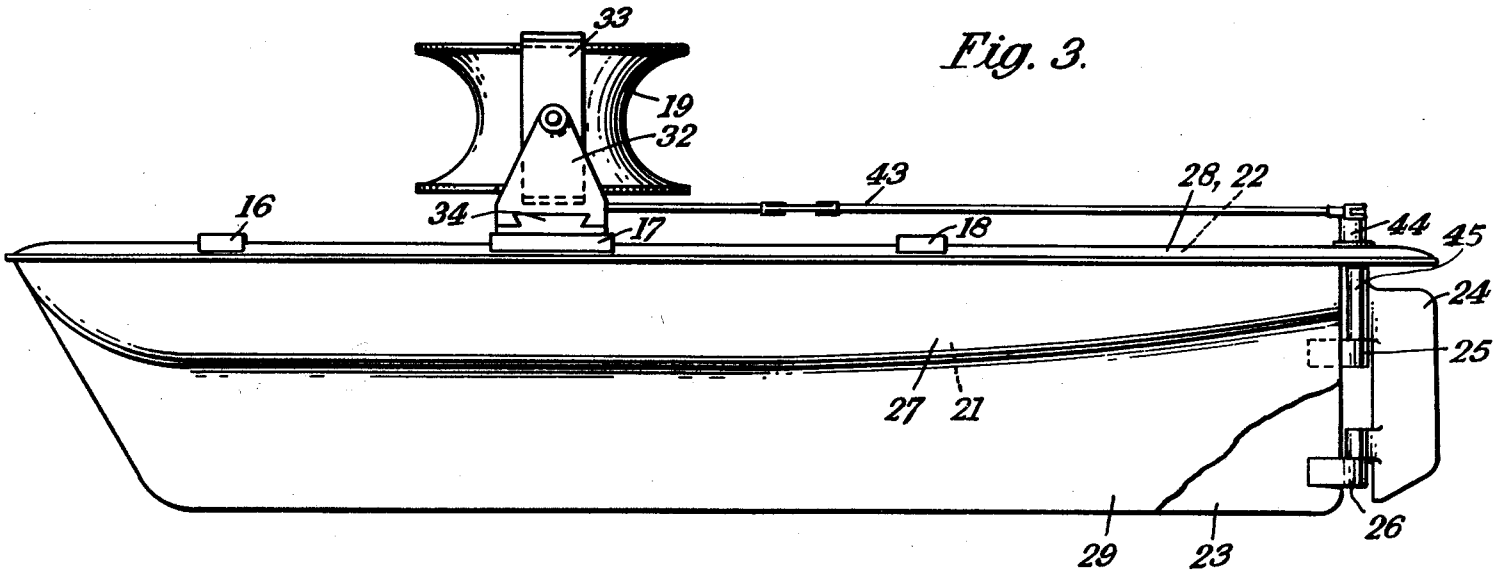
Figure 4:
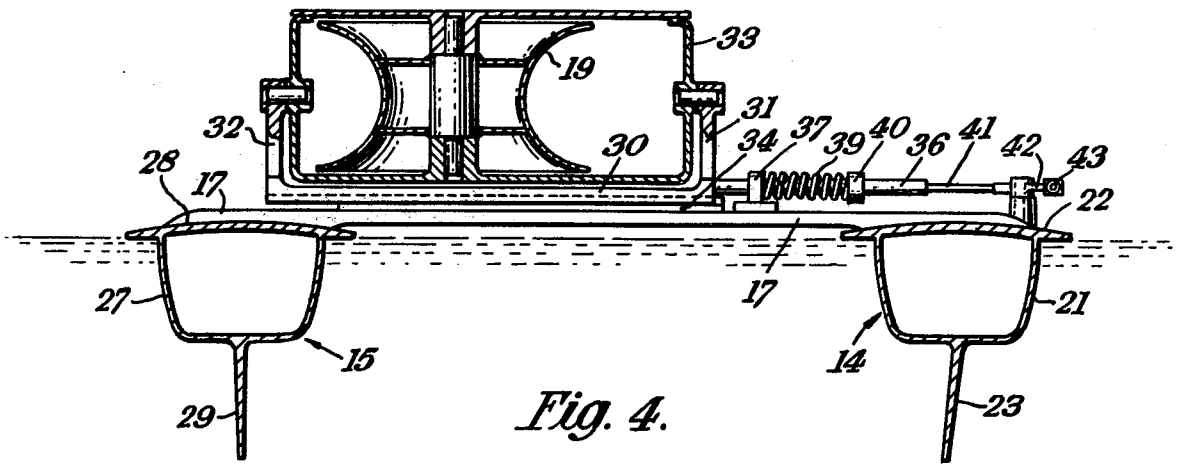

One embodiment of the invention will now be described by way of example with reference to the accompanying drawings in which:

FIG. 1 is a schematic plan view of oil recovery apparatus according to the invention in use in the removal of oil from an oil slick at sea, FIG. 2 is a plan view of a rope guide structure forming part of the apparatus shown in FIG. 1, drawn to an enlarged scale, FIG. 3 is a side elevation of the rope guide structure shown in FIG. 2, and FIG. 4 is a section of the rope guide structure shown in FIG. 2, taken on the line IV—IV in FIG. 2.

Referring first to FIG. 1, the oil recovery apparatus shown comprises a barge 11 from which is deployed an oil adsorbing rope 12 in the form of a continuous loop arranged to float on the water abaft of the barge as shown and a rope guide structure 13 in the form of a catamaran and comprising two float sub-structures 14 and 15 secured in spaced generally parallel relationship by cross beams 16, 17 and 18, the cross beam 17 supporting a rope pulley 19 around which the continuous loop of rope 12 passes. The rope 12 is continuously taken-up by and delivered from a drive and desorption unit 20 which is mounted at the stern of the barge and which serves to draw the oil laden run of the rope 12 from the water, to remove the oil from the rope and then feed the rope back into the water for further traverse to the guide pulley 19.

As shown in FIGS. 2 to 4, the sub-structure 14 comprises a streamlined hull portion 21 closed by a flat deck portion 22. The hull portion 21 is either air filled or filled with a foamed plastics material to provide a buoyancy which will just maintain the deck portion 22 in the surface of the water. The hull portion 21 is formed with a vane 23 depending from the underside thereof and extending as shown along the full length of the hull portion. A rudder 24 is rotatably mounted on supporting brackets 25 and 26 secured to the rear end of the vane 23.

The sub-structure 15 is identical to the sub-structure 14 and comprises a hull portion 27 closed by a deck portion 28 and is either air filled or filled with a foamed plastics material to provide a buoyancy sufficient to maintain the deck portion 28 in the surface of the water as shown. The hull portion 27 is furthermore provided with a vane 29 depending from the underside thereof and extending the full length of the hull portion.

It will be seen that with the rope guide structure 13 floating on the water surface, as shown, the vane 29 lies in a vertical plane, which for convenience is hereinafter referred to as a reference plane. The sub-structure 14 is, as seen in FIG. 2, so disposed in relation to the sub-structure 15 that the vane 23 is slightly further apart from the vane 29 at its forward end than it is at its aft end. In addition, the vane 23, as seen in FIG. 4 lies in a plane which is slightly inclined downwardly and toward the reference plane containing the vane 29. The inclinations of the vane 23 in relation to the vane 29 although not essential for deployment of the structure in use are preferred as it is believed that they provide for easier control of the movement of the structure through the water.

Referring again to FIG. 2, the midships cross beam 17 supports a cradle or slide 30 which pivotally supports on upstanding brackets 31 and 32 a pulley cage 33 carrying the pulley 19. In the disposition of the cage 33, as illustrated, the pulley is mounted therein for free rotation about a vertical axis while the cage itself is mounted in the cradle 30 for pivotal movement about a horizontal axis extending parallel to the cross beam 17. The slide 30, as seen in FIG. 3, is mounted on a slide bar 34 secured to the cross beam 17 to provide for displacement of the slide along the beam. To the support bracket 31 are secured two guide rods 35 and 36 which move longitudinally with the slide 30 and pass in sliding engagement through holes provided in a rod support bracket 37 secured to the cross beam 17. The rods 35 and 36 carry springs 38 and 39, which bear at one end against the rod support bracket 37 and at the other end against a brace 40 secured on the rods 35 and 36, but adjustable in regard to position therealong.

Displacement of the slide 30 is imparted to the rods 35 and 36 and to the brace 40 and transmitted to the rudder 24, as best seen in FIG. 2, by a linkage comprising a rod 41, a bell crank lever 42, a rod 43 of adjustable length and a radial arm 44 fixedly mounted on the upper end of a rudder shaft 45 to which the rudder 24 is secured.

In use, the slide 30 is subjected to a pull resulting from the tension in the rope 12 and takes up a position on its slide plate 32 in which the pull is balanced by the compressive force of the springs 38 and 39. An increase in the tension in the rope 12 above a predetermined tension causes the slide 30 to move in a direction away from the sub-structure 14 against the thrust from the springs 38 and 39 and displace the rudder 24 so that it decreases its angle of inclination. The rope guide structure 13 as a result changes its course permitting a reduction in rope tension. Conversely, following a decrease in tension below the predetermined tension, the slide 30 moves toward the sub-structure 14 under the thrust from the springs 38 and 39 causing the rudder 24 to take up a greater angle of inclination. As a result, the rope guide structure 13 is steered on a course which gives rise to an increase in rope tension.

Referring again to FIG. 1, the drive and desorption unit 20 carried by the barge 11 may conveniently comprise a pair of drive rollers arranged to be driven by a petrol or diesel engine via a chain drive and a clutch mechanism. The rollers from two nips through which the rope 12 passes in turn, the rollers serving to draw the oil laden run of the rope 12 from the water and advance it forwardly through the first nip of the rollers and then upon two reversals of direction forwardly through the second nip, from which it is then fed into the water for further traverse to the guide pulley 19, the rollers serving to squeeze out oil from the oil laden run advanced to it whilst providing the drive for the advancement of the rope. The recovered oil is conveniently collected in a storage tank within the barge 11 from which it may for example be pumped into flexible storage containers which are carried alongside the barge and which float by virtue of the buoyancy obtained from the oil fed to them. A drive and desorption unit of this kind is described and fully illustrated in copending British patent application No. 15249/75.

It has been found however that contamination of the drive rollers by the oil being squeezed from the rope can be troublesome, that lengthy maintenance procedures are required to clear the drive mechanisms of heavy oil and tar contaminants and that the drive and desorption unit 20 can with advantage take the form of the unit described in copending Patent application No. 36444/76. The unit described in the aforesaid copending application No. 36444/76 comprises oil extraction means through which the rope is advanced to extract the oil from the rope and which imparts no drive or substantially no drive to the rope and rope drive means spaced from the oil extraction means and by which it is advanced through the oil extraction means. The rope drive means is preferably such that it extracts no or substantially no oil from the rope and the oil laden rope is arranged first to pass through the oil extraction means and then through the rope drive means. The rope drive means may conveniently comprise a capstan carrying on its outer cylindrical surface a helical groove in which the rope is guided in one or more turns around the capstan, the number of turns and the diameter of the capstan being such that the capstan in operation brings the rope under tension and imparts a drive to the rope. The oil extraction means conveniently takes the form of a succession of stationary metal rings through which the rope is advanced successively, the internal diameters of the rings reducing gradually from ring to ring in the direction of travel of the rope and being of such dimensions as to cause the rope to be subjected to a gradually increasing compression, whereby oil is progressively squeezed from the rope by the rings and delivered into a storage tank or tanks arranged beneath the rings.

The rope guide structure 13 when not in use is stowed on the barge 11 and launched only when required. In the operation of the removal of oil from a slick 46 as shown in FIG. 1, the barge 11 is brought to a position some distance to the rear of the position shown in the drawings, where the rope guide structure 13 is launched complete with the rope 12 loosely passing around the guide pulley 19. The barge 11 is than advanced in the direction of the arrow A and the rope 12 gradually paid out until it is fully extended from the drive and desorption unit 20. Under full extension of the rope 12, the rope guide structure 13, by virtue of its vane and rudder orientation moves off to starboard and takes up the position to starboard as illustrated in FIG. 1 of the drawings. When the rope guide structure 13 has taken up the position shown, the rope is continuously advanced from and taken up by the drive and desorption unit 20 in the directions indicated by the arrows and the barge 11 is so steered as to take a course in which the two runs of the rope 12 advance in a transverse motion through the slick 46.

It can be shown theoretically that for a particular tension, hydrodynamic drag characteristic and ship speed, the rope 12 and the rope guide structure 13 will take up a unique configuration and that any one of a number of configurations may be chosen within a range set by the operational limits of the rope 12, the rope guide structure 13 and the barge 11. The rope guide structure 13 would furthermore maintain a position similar to that illustrated in FIG. 1 of the drawings, under most conditions, without the use of the rudder 24. However, variations in rope tension due to adverse weather conditions can lead to a reduction in the efficiency of the recovery apparatus and the rudder 19 is so arranged under the control of the displacement of the pulley 19 on the slide 30 as to redirect the rope guide structure 13 and maintain the tension in the rope 35 at a constant or substantially constant value.

More specifically, as the rope guide structure 13 moves from a position at the stern of the barge 11 up into the position shown in FIG. 1, the tension in the rope 12 progressively increases. During the initial part of this manoeuvre, the slide 30 holds a position in which the support bracket 31 thereon bears against the bracket 37 fixed to the cross beam 17. A position is then soon reached when the tension in the rope 12 overcomes the force of the springs 38 and 39. The pulley 19 on its slide 30 then moves in a direction away from the sub-structure 14, its movement being transmitted to the rod 43, which in turn causes a turning movement of the rudder 24 to a position in which it applies a reduced steering to starboard. The structure 13 changes course while still maintaining a pull on the rope 12 and a equilibrium position is then reached as shown in FIG. 1 when the tension in the rope 12 balances the compression of the springs 38 and 39. In this way, the rudder 24 is made effective to maintain the tension in the rope 12 at a predetermined constant or substantially constant value.

The oil recovery apparatus hereinbefore described, while operating well in calm waters is particularly suitable for oil recovery at sea under other than calm conditions. In a heavy swell or in adverse wind conditions, for example, the rope guide structure 13 is automatically subjected to course changes to maintain the rope under a constant tension. As a result, the rope 12 maintains a configuration effective for picking up oil from the surface of the water. As will be seen, the rope pulley 19 is rotatably mounted in a cage 33 which is itself rotatably mounted about a pitch axis so that excessive pitching movements of the rope guide structure 13 are not transmitted to the rope 12.

In some circumstances, it may be found desirable to provide a symmetrical arrangement for oil recovery, in which the barge 11, in addition, deploys a further continuous loop of rope extending from a further drive and desorption unit, the further rope being guided by a further rope guide structure similar to the rope guide structure 13 but arranged for maintaining the further rope to port of the barge 11.

In the embodiment hereinbefore described with reference to the drawings the vanes 23 and 29 are shown as extending for the full lengths of the hull portions 21 and 27. It will however be appreciated that for some applications it may be desirable to provide for one or the other or for each of the vanes 23 and 29 to extend for a part only of the length of the hull portion which supports it.

I claim:

1. Material recovery apparatus comprising a rope of an adsorbent material arranged for floating on the surface of a liquid contaminated by a contaminating material preferentially adsorbed by the rope, a floating desorption station and at least one floating rope guide structure remote from the desorption station, the rope being in the form of a continuous loop extending between the desorption station through which the rope is advanced to remove adsorbed material and the floating rope guide structure which includes a hull and a guide means around which the rope is guided, said rope guide structure further comprising means mounted on said hull and adapted to being disposed in the liquid for directing the floating rope guide structure into a substantially predetermined position relative to the floating desorption station in response to the tension of the rope during relative movement between the desorption station and the liquid to bring the rope into a disposition in which a part at least of the length thereof has a component of motion over the surface of the liquid and relative thereto which is transverse to the longitudinal direction of the said part, said rope guide structure including steering means having a rudder which is positioned in response to deviations in the tension of the rope from a predetermined tension to steer the rope guide structure to at least tend to maintain the tension of the rope at said predetermined tension, the steering means including tension sensing means for providing an output in response to changes in tension in the rope at the rope guide structure, and means coupling the output of the sensing means to the rudder, whereby the rudder steers the rope guide structure.

2. Apparatus according to claim 1, wherein said guide means on said rope guide structure comprises a guide pulley around which the continuous loop of rope passes.

3. Apparatus according to claim 2, wherein the sensing means includes the pulley and resilient biasing means, the pulley being displaceable to provide said output under the pull exerted by the rope against the action of the resilient biasing means.

4. Apparatus according to claim 3, wherein said sensing means includes stop means, the displacement of the pulley under the action of the resilient biasing means being limited by the stop means to provide for a predetermined maximum rudder inclination.

5. Apparatus according to claim 1, wherein the means for directing the floating rope guide structure includes at least one vane adapted to extend within the liquid substantially in the direction of movement of the floating rope guide structure when in its substantially predetermined position to direct the floating rope guide structure to bring the rope into said disposition.

6. Apparatus according to claim 1, wherein the means for directing the floating rope guide structure comprises a plurality of floating hull sub-structures secured in transversely spaced substantially parallel relationship.

7. Apparatus according to claim 6, wherein each hull sub-structure comprises a hull portion closed by a deck portion and having a buoyancy sufficient to maintain the deck portion in the surface of the liquid.

8. Apparatus according to claim 6, wherein the means for directing the rope guide structure includes a vane member depending from each hull sub-structure so disposed as to bring the rope to said disposition.

9. Apparatus according to claim 8, wherein a first vane member on one of the hull sub-structures is arranged to lie in a vertical plane when the rope guide structure is floating on the liquid and wherein a second vane member of the other hull sub-structure is arranged to be further apart from the first vane member at its forward end than it is at its aft end.

10. Apparatus according to claim 9, wherein the second vane member lies in plane inclined downwardly and toward the said vertical plane.

11. Apparatus according to claim 8, wherein the two hull sub-structures are of identical shape and size and the vane depending from each has a lower most edge which runs parallel to the deck portion.

12. Material recovery apparatus comprising a rope of an adsorbent material arranged for floating on the surface of a liquid contaminated by a contaminating material preferentially adsorbed by the rope, a floating desorption station and at least one floating rope guide structure including rope guide means comprising a guide pulley, the rope being in the form of a continuous loop extending between the desorption station through which the rope is advanced to remove adsorbed material and the floating rope guide structure at which the rope is guided around the guide pulley, said rope guide structure including means mounted on said hull and adapted to being disposed in the liquid for directing the floating rope guide structure into a substantially predetermined position relative to the floating desorption station in response to the tension of the rope during relative movement between the desorption station and the liquid to automatically bring the rope into a disposition in which a part at least of the length thereof has a component of motion over the surface of the liquid and relative thereto which is transverse to the longitudinal direction of the said part, said rope guide structure including steering means having a rudder which is positioned in response to deviations in the tension of the rope from a predetermined tension so to steer the rope guide structure as to at least tend to maintain the tension of the rope at said predetermined tension, said steering means including resilient biasing means associated with said pulley, said pulley being displaceable under the tension of the rope from the predetermined tension against the action of the resilient biasing means for controlling the rudder in dependence upon displacements of the pulley.

13. Apparatus according to claim 12, wherein the means for directing the floating rope guide structure includes vane means adapted to extend within the liquid substantially in the direction of movement of the floating rope guide structure when in its substantially predetermined position to direct the floating rope guide structure to bring the rope into said disposition.

14. Material recovery apparatus comprising a rope of an adsorbent material arranged for floating on the surface of a liquid contaminated by a contaminating material preferentially adsorbed by the rope, a floating desorption station and at least one floating rope guide structure including rope guide means, the rope being in the form of a continuous loop extending between the desorption station through which the rope is advanced to remove adsorbed material and the floating rope guide structure at which the rope is guided around the guide means, said rope guide structure including means mounted on said hull and adapted to being disposed in the liquid for directing the floating rope guide structure into a substantially predetermined position relative to the floating desorption station in response to the tension of the rope during relative movement between the desorption station and the liquid to automatically bring the rope into a disposition in which a part at least of the length thereof has a component of motion over the surface of the liquid and relative thereto which is transverse to the longitudinal direction of the said part, the rope guide structure including steering means responsive to deviations in the tension of the rope from a predetermined tension so to steer the rope guide structure as to at least tend to maintain the tension of the rope at said predetermined tension, said rope guide structure comprising a plurality of floating hull sub-structures secured in transversely spaced substantially parallel relationship, said means for directing the floating rope guide structure comprising a vane depending from the underside of each hull sub-structure and so disposed as to bring the rope to said disposition.

15. Material recovery apparatus comprising a rope of an adsorbent material arranged for floating on the surface of a liquid contaminated by a contaminating material preferentially adsorbed by the rope, a floating desorption station and at least one floating rope guide structure including rope guide means, the rope being in the form of a continuous loop extending between the desorption station through which the rope is advanced to remove adsorbed material and the floating rope guide structure at which the rope is guided around the guide means, said rope guide structure including means mounted on said hull and adapted to being disposed in the liquid for directing the floating rope guide structure into a substantially predetermined position relative to the floating desorption station in response to the tension of the rope to bring the rope into a disposition in which a part at least of the length thereof has a component of motion over the surface of the liquid and relative thereto which is transverse to the longitudinal direction of the said part, said rope guide structure also including sensing means for sensing the tension on the rope during relative movement between the desorption station and the liquid and steering means coupled with said sensing means responsive to deviations in the sensed tension of the rope from a predetermined tension for steering the rope guide structure so as to at least tend to maintain the tension of the rope at said predetermined tension.

16. Apparatus according to claim 15, wherein the means for directing the floating rope guide structure includes vane means adapted to extend within the liquid substantially in the direction of movement of the floating rope guide structure when in its substantially predetermined position to direct the floating rope guide structure to bring the rope into said disposition and wherein said steering means includes a rudder which is positioned in response to the sensed tension of the rope to steer the rope guide structure to at least tend to maintain the tension of the rope at said predetermined tension, and coupling means for coupling the rudder to the sensing means.

* * * * *